US005544869A

United States Patent [19]

Chifo

[11] Patent Number: 5,544,869

[45] Date of Patent: Aug. 13, 1996

[54] APPARATUS FOR PLATING TUBING AND OTHER SHAPES

[76] Inventor: Peter K. Chifo, 702 W. Oakcrest Ave., Brea, Calif. 92621

[21] Appl. No.: 293,709

[22] Filed: Aug. 22, 1994

[51] Int. Cl.[6] ..... C23C 2/06

[52] U.S. Cl. ..... 266/88; 266/120; 118/405; 118/667

[58] Field of Search ..... 266/120, 88; 427/433; 118/667, 620, 405, 419, 423, DIG. 11, DIG. 13

[56] References Cited

U.S. PATENT DOCUMENTS 3,001,508 9/1961 Elliott ..... 266/120
3,479,210 11/1969 Ross ..... 118/667
4,330,574 5/1982 Pierson ..... 427/433
4,814,210 3/1989 Ackermann ..... 427/433

*Primary Examiner*—Melvyn Andrews
*Attorney, Agent, or Firm*—Bruce H. Johnsonbaugh

[57] ABSTRACT

An apparatus and method for continuously applying a zinc plating to tubing is provided having a lower reservoir of molten zinc, an elongated and enclosed plating chamber having a plating trough formed in its upper surface, a pump for transferring molten zinc from the reservoir to the plating trough, a temperature sensor monitoring the temperature of the zinc in the plating trough and gas fired strip burners carried in the plating enclosure for heating the zinc transferred from the lower reservoir into the plating trough, the strip burners cooperating with the sensor for maintaining the bath of zinc in the plating trough within a predetermined temperature range.

12 Claims, 7 Drawing Sheets

APPARATUS FOR PLATING TUBING AND OTHER SHAPES

BACKGROUND OF THE INVENTION

This invention relates generally to the plating of tubing and other shapes. In particular, the present invention relates to an apparatus and method for continuous galvanizing of tubing.

The prior art has traditionally utilized a molten metal bath such as zinc contained in a reservoir located under the plating trough. The molten zinc is pumped into a separate trough located at the product passline. The pumping rate is adjusted to maintain galvanizing temperatures in the trough of between 820° F. to 850° F. The primary disadvantage with this prior art method is that the initial design capacity is limited to a predetermined throughput; if the workpiece preheat levels are insufficient or if the pump rates are insufficient, the bath temperature in the trough will drop below minimum galvanizing temperatures because of the considerable amount of heat given up from the bath to the lower temperature tubing or other shape.

A further disadvantage of this prior art method is that rather large amounts of molten zinc are recirculated from the plating trough to the primary reservoir of molten zinc. This relatively large return of molten zinc from the plating trough increases the requirement for heat input to and higher pumping rates for the lower reservoir of molten zinc. Additionally, this practice tends to return molten zinc to the lower or primary reservoir which has begun to oxidize. The higher pump rate for the reservoir causes turbulence which in turn creates significant dross formation and kettle wash out or erosion.

BRIEF SUMMARY OF THE INVENTION

In accordance with the present invention, an elongate heating chamber is provided having a longitudinal trough formed in its upper surface. A transfer unit or pump is provided to lift or transfer molten zinc from the reservoir into the plating trough to maintain the desired depth of molten zinc in the plating trough. A large capacity heating system is provided in the enclosed chamber beneath the plating trough to continuously heat the zinc in the plating trough (without heating the lower or primary reservoir of molten zinc) to maintain proper galvanizing temperatures. This method facilitates greatly increased production rates and significantly reduces the amount of zinc returned from the plating trough to the lower or primary reservoir.

A primary object of the present invention is to provide an apparatus and method for continuously plating tubing and other shapes wherein the molten plating material in the plating trough is being continuously heated to maintain proper plating temperatures to compensate for heat loss transferred from the molten plating material in the tough to the workpiece and to the atmosphere.

A further object of the present invention is to provide an apparatus and method for the continuous and automatic galvanizing of tubing wherein the amount of zinc returned to the lower or primary reservoir from the plating trough is minimized. This in turn reduces the heat input required to the lower or primary reservoir and furthermore reduces the level of oxidized zinc in the lower or primary reservoir.

Another object of the invention is to provide an apparatus and method for plating tubing and other shapes wherein pump rates for the lower or primary reservoir are minimized, thereby increasing pump life and reducing dross formation and kettle wash out or erosion.

A further object of the invention is to provide an apparatus and method for continuous plating of tubing wherein the plating trough may be sealed from atmosphere to reduce oxidation and wherein a heating chamber provided beneath the plating trough is sealed from the atmosphere to reduce oxidation and to provide uniform heating of the plating bath.

A still further object of the invention is to provide a pumping mechanism for transferring molten zinc from a lower reservoir upwardly to a plating trough having a design that inherently allows a method for the plating bath to rapidly drain through the pumping mechanism to the lower or primary reservoir when the production line is shut down.

Other objects and advantages of the invention will become apparent from the following description of the preferred embodiment and the drawings wherein:

DETAILED DESCRIPTION OF THE DRAWINGS

Figure 1:
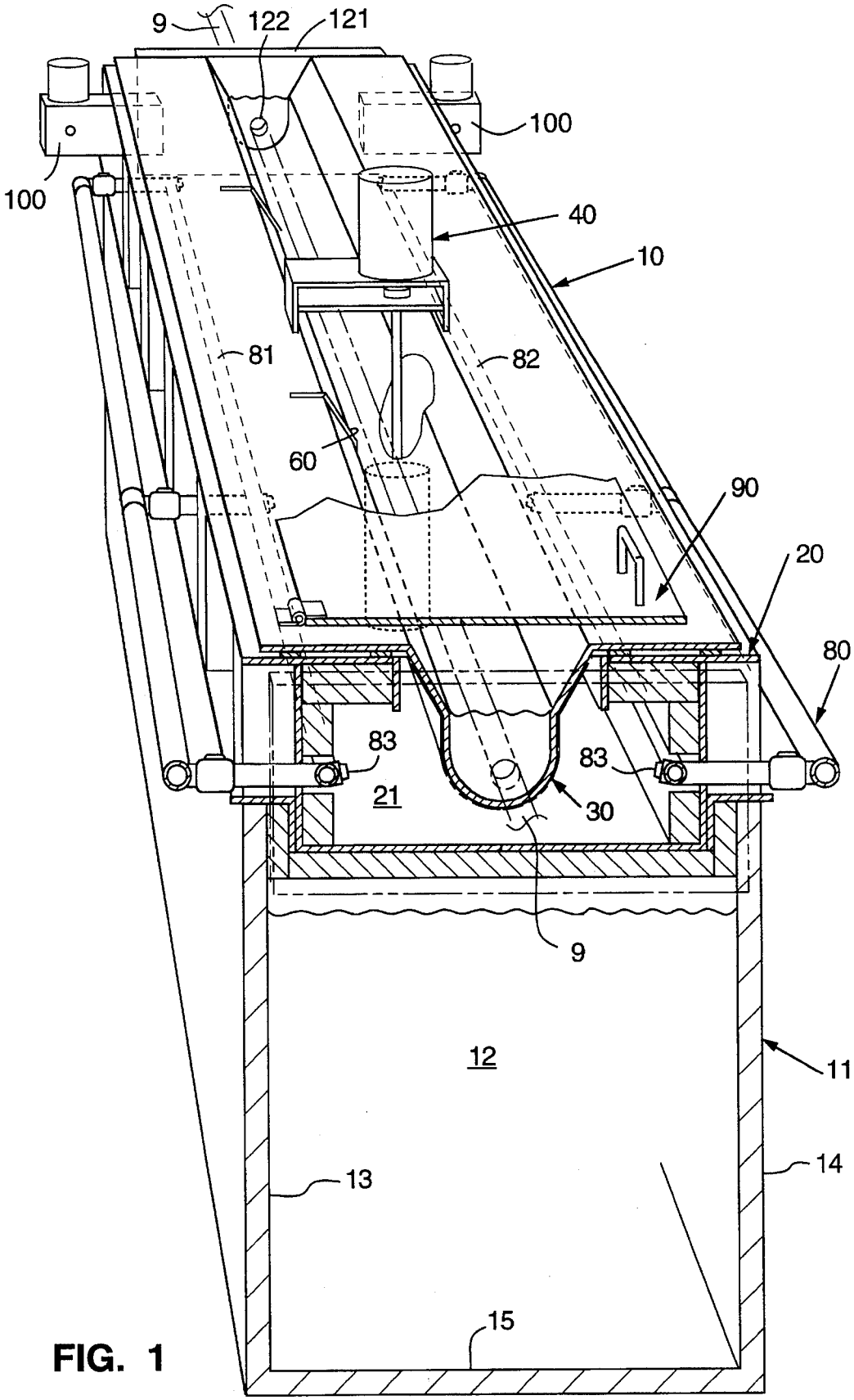
FIG. 1 is a perspective view, partially in section, showing the plating apparatus according to the present invention, with the front end cap removed.

As shown in FIG. 1, an apparatus 10 is provided for plating tubing and other shaped material. The apparatus is designed for use in galvanizing cylindrical tubing, but can be readily modified to plate shapes other than cylindrical tubing. In the discussion below, it should be understood that other shapes may be plated, and the term "tubing" should be construed broadly to include other shapes. Furthermore, coatings other than molten zinc may be applied to tubing and other shapes.

A lower or primary reservoir 11 is provided for storing molten plating material. 12. The molten material 12 is zinc in the case where the invention is used to galvanize tubing. The molten zinc 12 contained in reservoir 11 is maintained in its molten state by conventional gas fired burners or by induction heating (not shown). Reservoir 11 is rectangular in cross section having vertical side walls 13 and 14 and a horizontal lower wall or floor 15. Reservoir 11 is elongated and has front and rear walls 16 and 17 shown best in FIG. 4.

Figure 5:
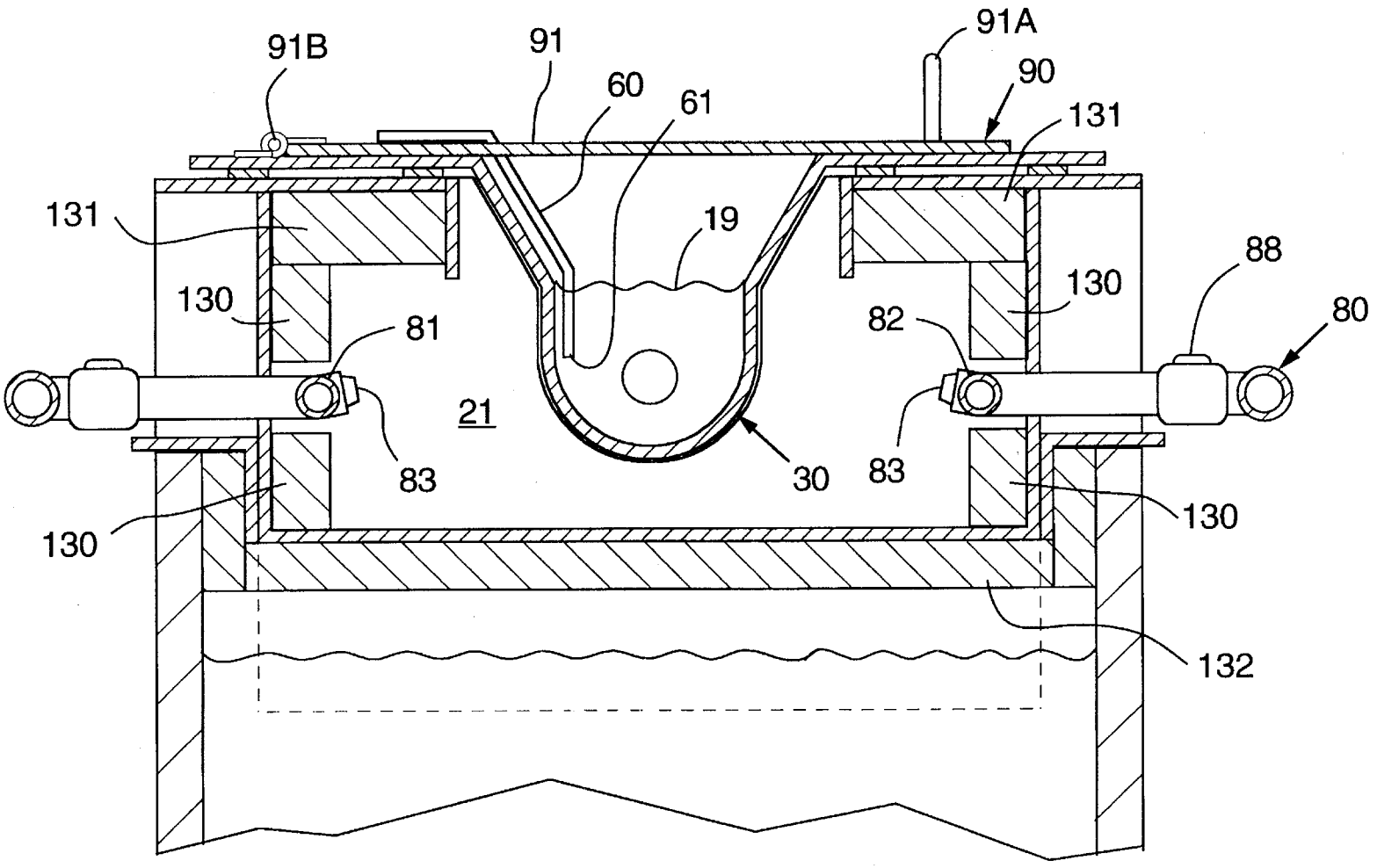
FIG. 5 is a sectional view along the line 5—5 of FIG. 4.

A plating enclosure means 20 forms an elongated and enclosed chamber 21 shown best in FIGS. 1 and 5. The plating enclosure means 20 also has a longitudinal plating trough shown generally as 30 formed in its upper surface.

Figure 2:
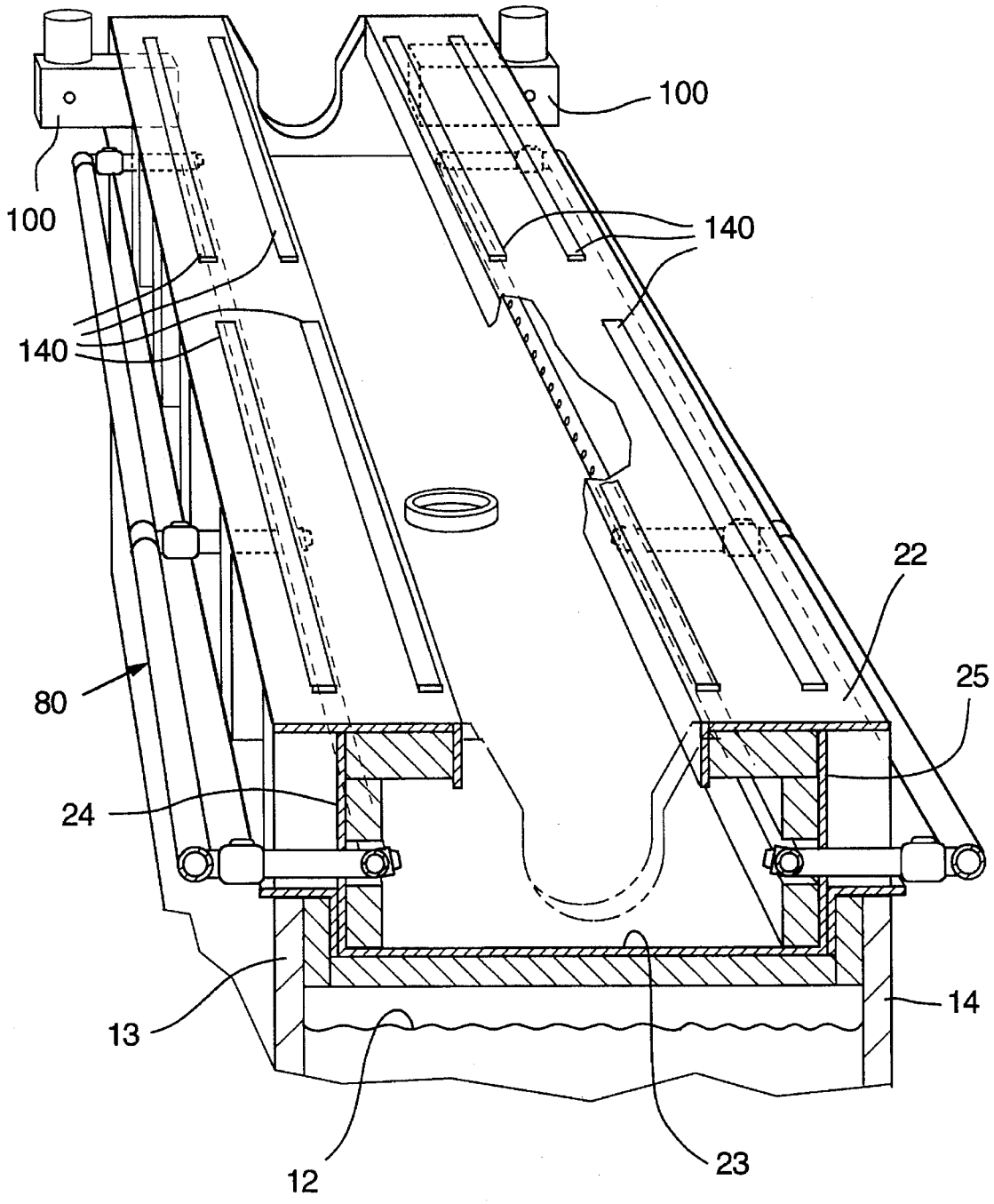
FIG. 2 is a perspective view of the lower portion of the plating enclosure which has a generally U-shaped cross section.
Figure 3:
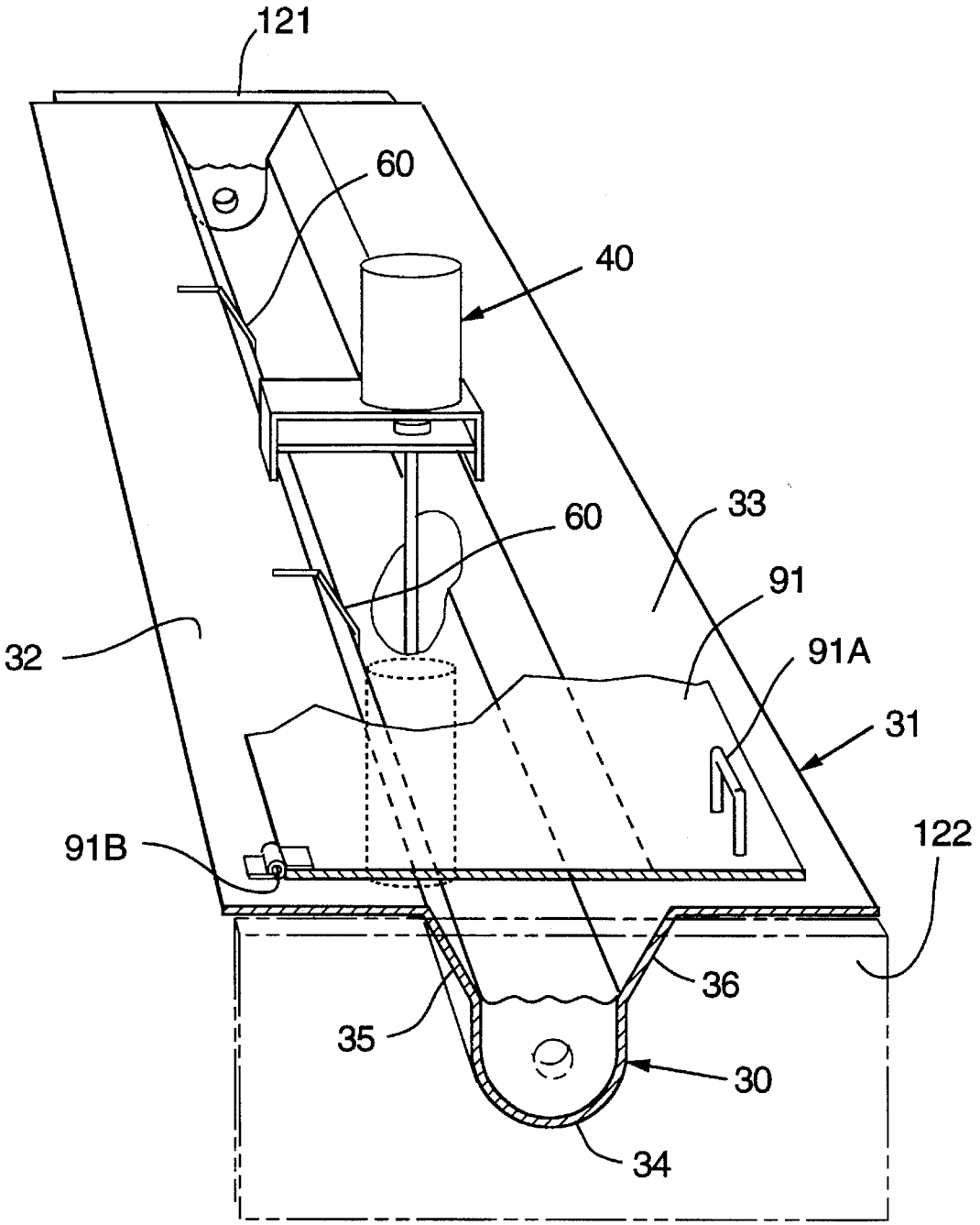
FIG. 3 is a perspective view of the removable upper portion of the plating enclosure which forms the plating trough according to the present invention, with the front end cap shown in phantom.

As shown best in FIGS. 2 and 3, the plating enclosure means 20 of FIG. 1 comprises a lower portion 22 shown in FIG. 2 having a generally U-shaped cross section formed by lower wall 23 and side walls 24 and 25. As shown best in FIG. 3, the plating enclosure 20 of FIG. 1 has a removable upper portion 31 comprising horizontal flanges 32 and 33, which are each elongated rectangular strips, and a plating trough 30. Plating trough 30 has an arcuate base 34 which is suspended from horizontal flanges 32 and 33 by tapered wall sections 35 and 36. It is understood that the cross-sectional design of the plating trough can be readily modified to accommodate shapes other than cylindrical tubing. The shape shown in FIG. 3 is the preferred design for use in plating cylindrical tubing.

As shown in FIG. 1, the plating enclosure means 20 is located above and is carried by reservoir 11.

Figure 6:
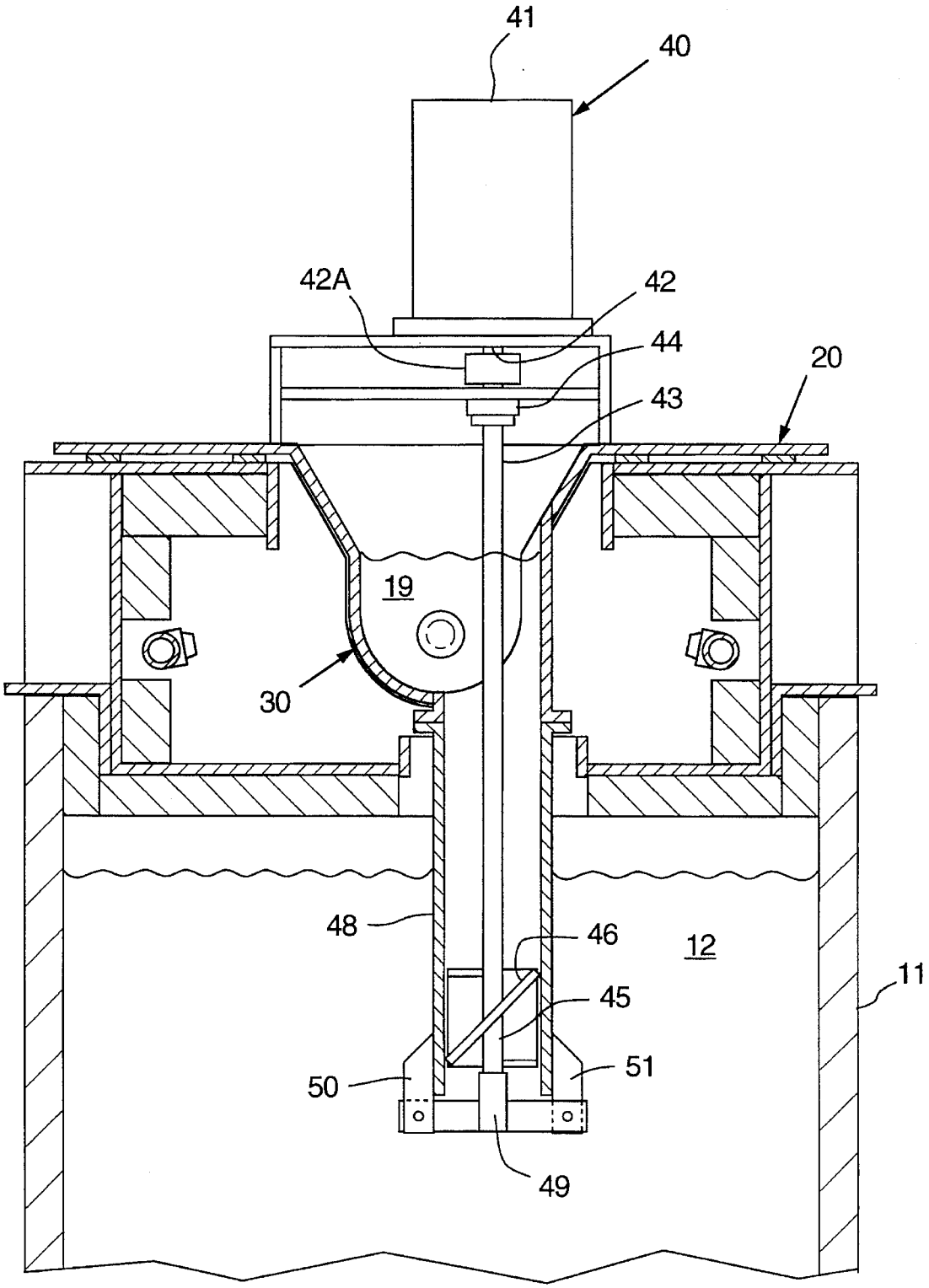
FIG. 6 is a sectional view along the line 6—6 of FIG. 4 showing the pumping or transferring mechanism of the present invention.
Figure 7:
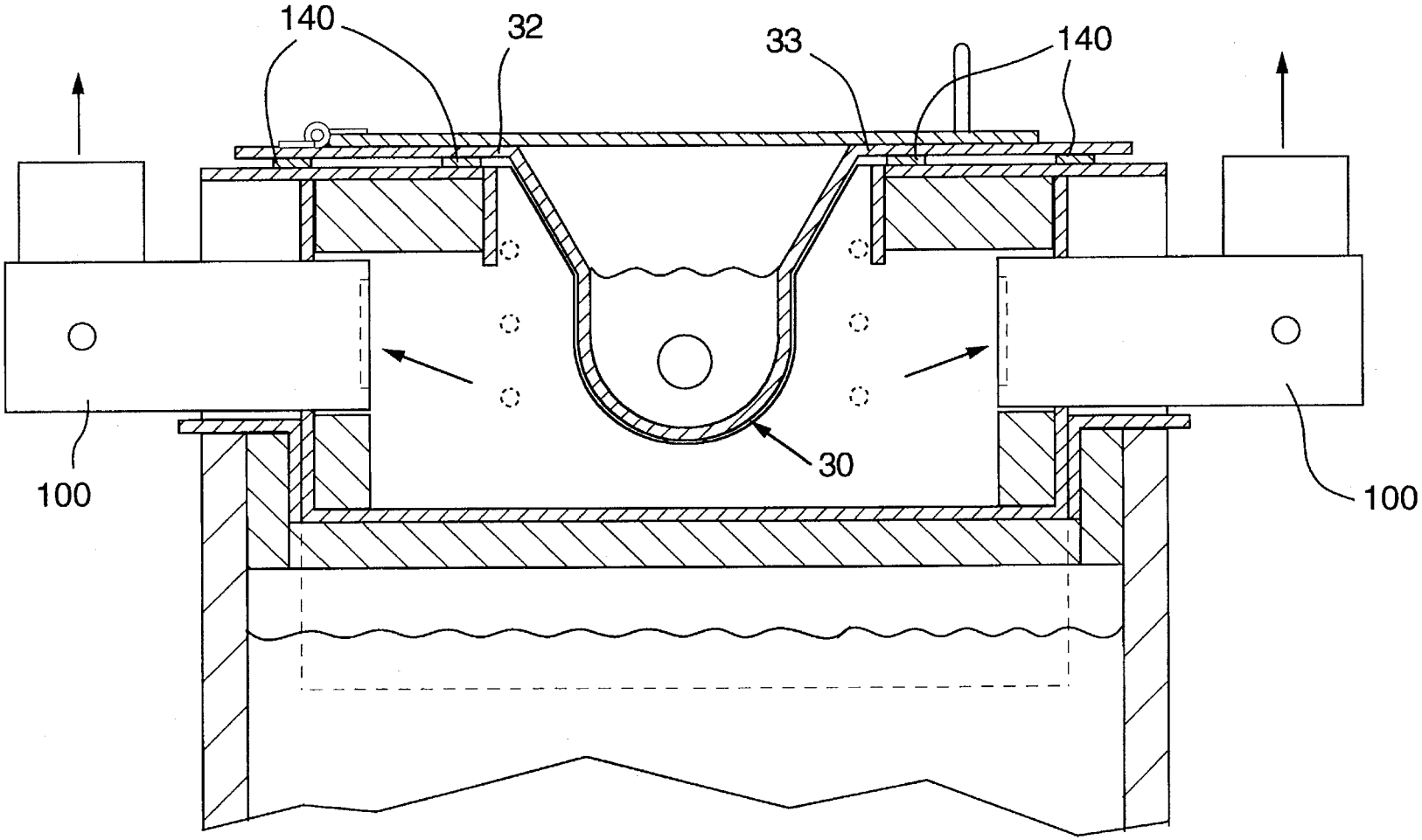
FIG. 7 is a sectional view along the line 7—7 of FIG. 4.

A transfer means or pumping means 40 (FIGS. 1 and 3) is carried by flanges 32 and 33 and lifts molten zinc 12 from reservoir 11 upwardly into plating trough 30. It is understood that the pumping or transfer means 40 could be of alternate design and the phrase "transfer means" is broad enough to include a gravity feed. In the embodiment shown in the figures, pump or transfer means 40 is shown best in FIG. 6 and includes a variable speed and automatically reversing motor 41 having an output shaft 42. Shaft 42 is connected to pump drive shaft 43 through a quick disconnect fitting 44. Drive shaft 43 extends downwardly into reservoir 11 and into the molten zinc 12. The lower end 45 of shaft 43 carries an impeller 46. Impeller 46 when rotated pumps molten zinc 12 upwardly through cylinder 48 into the plating trough 30. Cylinder 48 extends downwardly through plating trough 30 and the enclosed chamber 20 into lower or primary reservoir 11. At the lowermost portion of cylinder 48, a thrust bearing 49 is supported by ears 50 and 51 for resisting the downward thrust of shaft 43 caused by the rotation of impeller 46 in a direction to pump molten zinc 12 upwardly. An upper bearing **42*a* is mounted between motor 41 and trough 30** which also bears the load from pumping and reversing.

Pump means 40 provides a plating bath 19 of desired depth in longitudinal plating trough 30.

When motor 41 is turned off or reversed, as in the event of shutting down a production line or for any other reason, motor 41 automatically reverses and the plating bath 19 in longitudinal trough 30 quickly drains or is pumped downwardly through cylinder 48 into lower or primary reservoir 11. This is a significant safety feature in that, if an open seam tube should be immersed into molten zinc, there is a possibility for an explosion of the zinc. By automatically reversing the motor on stopping the line, the rapid transfer to zinc to the lower reservoir minimizes the possibility of such an event.

Figure 4:
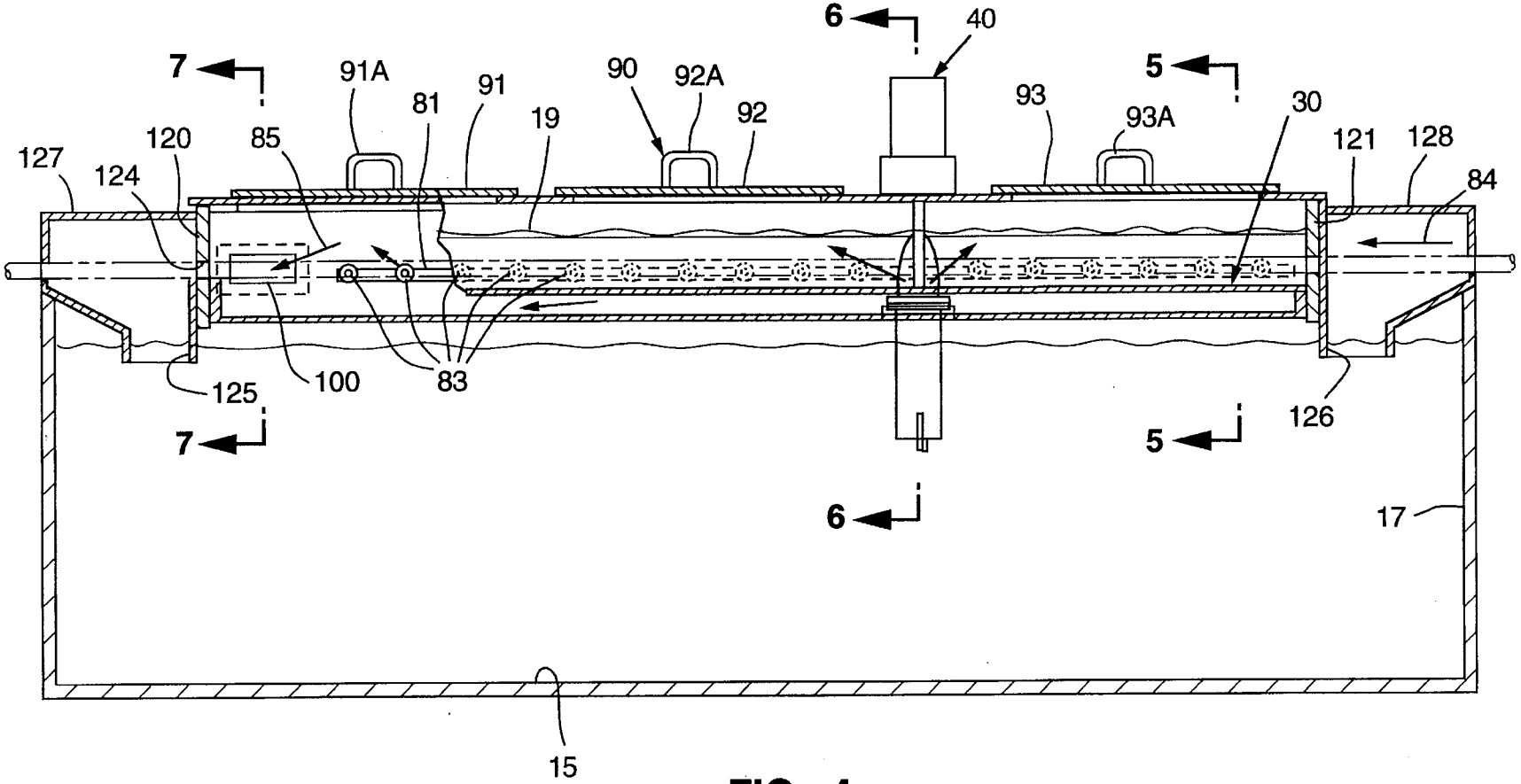
FIG. 4 is a side elevation of the plating apparatus of FIG. 1 shown partially in section.

In order to prevent oxidation of the plating bath 19, a plating trough cover means 90 is provided (FIGS. 4 and 5). Cover means 90 includes a plurality of hinged plates 91,92 and 93 which may be lifted by handles **91*a*,92*a* and 93*a*, respectively, to gain access to the plating trough 30. Each of the plates 91,92 and 93 is hinged in similar fashion to hinge 91*b* shown in FIG. 3. When cover means 90 is in its closed position, as shown in FIGS. 4 and 5, the plating bath 19 is sealed off from the atmosphere and inert gases may be introduced into the region above plating bath 19 to reduce or prevent oxidation of the bath 19**.

A temperature sensing means 60 (FIG. 5) of conventional design is provided for continuously sensing or monitoring the temperature of plating bath 19. Sensing tip 61 extends downwardly below the surface of plating bath 19.

Heating means shown generally as 80 includes a plurality of strip burners, i.e., in FIG. 1 two strip burners 81 and 82 are shown in phantom. As shown best in FIG. 4, each strip burner contains a plurality of burner orifices 83 which extend throughout the length of strip burners 81 and 82. It is advantageous to use a fuel air mixture introduced into strip burner 81 as shown at arrow 84 in FIG. 4. The fuel air mixture, after combustion, is then exhausted in the direction of arrow 85 shown in FIG. 4 into exhaust port 100. By using a fuel air mixture in sealed chamber 21, oxidation of plating trough 30 and the interior of chamber 21 is reduced. Strip burners 81 and 82 are elongated and extend the entire length of plating trough 30 and are carried on opposite sides of plating trough 30 as shown in FIG. 5 to provide uniform heat transfer into plating bath 19 along the entire length of plating trough 30. It is to be understood that the size and number of burning orifices 83 may be increased to raise the overall amount of heat being transferred into plating bath 19. It is also intended that various heating systems could be used other than gas fired burners, such as oil heating or electrical resistance systems. In this fashion, higher rates of production throughput may be accommodated because heating means 80 is only heating the relatively small volume plating bath 19 and does not heat the primary reservoir 11. Conventional fuel air mixers and pilot igniters may be utilized in the strip burners. Balancing valves 88 are provided to equalize or to adjust the size of the flame along each of the strip burners.

The strip burners 81 and 82 remain ignited during the plating operation. The heat output of strip burners 81 and 82 is increased as needed by feeding more fuel to the burners until the temperature sensed by sensor 61 of plating bath 19 has achieved a predetermined temperature. At that point, heat output of burners 81 and 82 is reduced, but the burners stay on.

As shown best in FIG. 4, the plating trough 30 has front and rear end pieces 120 and 121 respectively mounted at each end of trough 30. As shown best in FIG. 1, rear end piece 121 encloses the end of plating trough 30 and has a passageway 122 formed therein through which the production throughput of tubing 9 is introduced. The clearance between production throughput tubing 9 and passageway 122 determines the thickness of the zinc coating applied to tubing 9. The final thickness and coating quality is accomplished by a downstream air knife (not shown) or integral mechanical wipe (not shown). There is a small flow of zinc through the gap between tubing 9 and passageway 122 which returns to an isolated chamber region 126 of reservoir 11. A similar flow of zinc passes between passageway 124 in front end plate 120 and tubing 9 and returns to isolated chamber region 125 of reservoir 11. Isolated chambers 125 and 126 are located at the end of reservoir 11 to maximize their distance from the intake of pump means 40. Chambers 125 and 126 confine the overflow to that part of reservoir 11 under atmosphere. Chambers 125 and 126 have upper surfaces 127 and 128, respectively, which seal the ends of trough 30 to the level of plating bath 19.

Chamber 21 is fully insulated, including side wall insulation 130, upper insulation pads 131 and base insulation 132. The insulation helps achieve and maintain a uniform temperature throughout the length and depth of plating bath 19.

Intergap spacer plates 140 are elongated strips carried on the top of lower portion 22 of enclosure 20 (FIG. 2). The flanges 32 and 33 are supported by spacer plates 140. The purpose of plates 140 is to resist the tendency of flanges 32 and 33 to warp from continued intense application of heat.

The invention disclosed herein may be used to retrofit existing installations to increase throughput capacity and may be also utilized in new installations. The cost savings as a result of utilizing the invention include less pump maintenance, increased life of pump and reservoir, and less conversion of zinc to by-product.

I claim:

1. Apparatus for plating tubing and other shaped material comprising:

a reservoir adapted to hold molten plating material, first heating means for heating said plating material in said reservoir and keeping said material molten, a plating enclosure means having upper and lower surfaces which forms an elongated chamber having a longitudinal plating trough formed in said upper surface, transfer means for moving molten plating material from said reservoir to said longitudinal plating trough, temperature sensing means for measuring the temperature of said molten plating material in said plating trough, and second heating means carried within said plating enclosure means for heating said molten plating material transferred from said reservoir into said plating trough, said second heating means co-operating with said temperature sensing means for maintaining the temperature of said molten plating material in said trough.

2. The apparatus of claim 1 wherein said second heating means comprises two gas fired strip burners, wherein each strip burner extends the length of and parallel to said longitudinal trough, said strip burners being located on opposite sides of said trough, and wherein each strip burner contains a plurality of orifices located along its length.

3. The apparatus of claim 2 wherein said plating enclosure means comprises:

a lower portion having a generally U-shaped cross-section which carries said strip burners, and a removable upper portion which forms said trough.

4. The apparatus of claim 1 wherein said plating enclosure means is located above and carried by said reservoir of molten plating material and wherein said transfer means comprises a motor driven pump which lifts molten zinc from said reservoir upwardly into said trough.

5. The apparatus of claim 4 wherein said motor automatically reverses on shutdown and said pump comprises a cylinder extending downwardly through said trough and said plating enclosure means into said reservoir of molten plating material, and an impeller driven by said motor carried at the lower end of said cylinder, whereby molten plating material in said trough is pumped or drains downwardly through said cylinder into said reservoir when said motor is turned off or automatically reversed.

6. Apparatus for continuously and automatically applying a zinc plating to tubing comprising:

a reservoir adapted to hold molten zinc, first heating means for heating said plating material in said reservoir and keeping said material molten, a plating enclosure means having upper and lower surfaces which forms an elongated and enclosed chamber having a plating trough formed in said upper surface, pumping means for transferring molten zinc from said reservoir to said elongated plating trough, temperature sensing means for measuring the temperature of said molten zinc in said trough, and second heating means carried within said plating enclosure means for heating said zinc transferred from said reservoir into said trough, said second heating means cooperating with said sensing means for maintaining the temperature of said molten zinc in said trough.

7. Apparatus for continuously and automatically applying a zinc plating to tubing, wherein the apparatus may be retrofitted into existing installations to increase throughput or may be used in new installations comprising:

a reservoir adapted to hold molten zinc, first heating means for heating said reservoir of molten zinc and maintaining a temperature of the molten zinc, an elongated plating enclosure means having upper and lower surfaces sealed from the atmosphere and having an elongated plating trough formed in said upper surface, pumping means for transferring molten zinc from said reservoir to said elongated plating trough, temperature sensing means for measuring the temperature of molten zinc in said trough, and second heating means carried within said plating enclosure means for heating said zinc transferred from said reservoir into said trough, said second heating means cooperating with said sensing means for maintaining the temperature of said molten zinc in said trough.

8. The apparatus of claim 7 wherein said second heating means comprises a plurality of strip burners each having a plurality of burner orifices whereby the heating capacity of said second heating means may be increased to accommodate high production throughput rates of tubing.

9. The apparatus of claim 7 further comprising plating trough cover means for sealing said plating trough from atmosphere and allowing the introduction of inert gas into said plating trough to prevent oxidation of the molten zinc in the plating trough.

10. The apparatus of claim 7 wherein said plating trough has two ends, and each end is covered by an end plate, each end plate having an opening formed therein which controls the thickness of zinc applied to said tubing.

11. The apparatus of claim 10 wherein said openings formed in said end plates create a predetermined clearance from the tubing, which in turn limits the amount of molten zinc returned to said reservoir, whereby dross and zinc oxide formation is reduced, turbulence in said reservoir is reduced and the life of said reservoir is maximized.

12. The apparatus of claim 1 wherein said second heating means comprises two electric resistance heating elements, wherein each of said heating elements extends the length of and parallel to said longitudinal trough, said elements being located on opposite sides of said trough.

* * * * *